US009767646B1

(12) United States Patent
Guziel et al.

(10) Patent No.: US 9,767,646 B1
(45) Date of Patent: Sep. 19, 2017

(54) NETWORKED GAME SELECTIVELY OPERATIVELY ENGAGED WITH SECOND OPPORTUNITY RANDOM DRAW GAME

(71) Applicant: Alchemy3, LLC, Alpharetta, GA (US)

(72) Inventors: Paul Francis Guziel, Roswell, GA (US); David Jason Schorr, Cumming, GA (US)

(73) Assignee: Alchemy3, LLC, Roswell, GA (US)

( * ) Notice: Subject to any disclaimer, the term of this patent is extended or adjusted under 35 U.S.C. 154(b) by 451 days.

(21) Appl. No.: 14/107,756

(22) Filed: Dec. 16, 2013

Related U.S. Application Data

(60) Provisional application No. 61/737,756, filed on Dec. 15, 2012.

(51) Int. Cl.
*G07F 17/32* (2006.01)

(52) U.S. Cl.
CPC ..... *G07F 17/3244* (2013.01)

(58) Field of Classification Search
CPC ..... A63F 13/00; G07F 17/32; G07F 17/3244
See application file for complete search history.

(56) References Cited

U.S. PATENT DOCUMENTS

| | | | | |
|---|---|---|---|---|
| 7,896,193 | B1 * | 3/2011 | Spadafora | G06Q 20/387 194/220 |
| 2002/0058543 | A1 * | 5/2002 | Walker | A63F 1/00 463/13 |
| 2003/0100360 | A1 * | 5/2003 | Manfredi | G07F 17/32 463/25 |
| 2004/0176158 | A1 * | 9/2004 | Baldwin | G07F 17/32 463/17 |
| 2010/0227675 | A1 * | 9/2010 | Luxton | G07F 17/32 463/25 |
| 2010/0267438 | A1 * | 10/2010 | Williams | G07F 17/32 463/17 |
| 2011/0053671 | A1 * | 3/2011 | Aoki | G07F 17/32 463/16 |
| 2012/0214564 | A1 * | 8/2012 | Barclay | G07F 17/3227 463/11 |

* cited by examiner

*Primary Examiner* — Kang Hu
*Assistant Examiner* — Jeffrey Wong
(74) *Attorney, Agent, or Firm* — Baker Donelson

(57) ABSTRACT

A networked game and method for entry of a non-winning game ticket in a second opportunity random draw game using a computer device that communicates with the game provider, each game player having a unique identifier and a determined balance of chips for selective use during game play shown on a display and at least one control feature selectively operative by the game player to play to an outcome for obtaining additional chips or not, with additional chips awarded to the player upon registering a non-winning ticket of a random draw game in the second opportunity game.

25 Claims, 10 Drawing Sheets

NETWORKED GAME SELECTIVELY OPERATIVELY ENGAGED WITH SECOND OPPORTUNITY RANDOM DRAW GAME

TECHNICAL FIELD

The present invention relates to interactive network games that may be played on computer devices including mobile computer devices. More particularly, the present invention is directed to an interactive network game that may played by a game player individually or as a group with other game players using separate computer devices while facilitating intraplayer communications during play of the game as well as selectively engaging with a second opportunity random-draw game offered by a game provider.

BACKGROUND OF THE INVENTION

Random-draw games are offered by game providers in various jurisdictions. The random-draw games conventionally provide monetary prize payouts for a game ticket having game play numbers that match numbers drawn randomly from a pool of numbers during play of the game. A game player selects in advance of the game event numbers to be played in the random-draw game. The selected numbers are conventionally memorialized in a game ticket sold to the game player by a ticket retailer. During play of the game, the game provider causes a predetermined number of numbers to be selected randomly from a pool of numbers. A game player holding a game ticket with selected numbers that match the numbers drawn randomly during play of the game wins a prize.

To encourage those game players holding non-winning tickets, game providers often provide a second opportunity random-draw game. The game player with a non-winning ticket may selectively enter the non-winning game ticket into the second opportunity random-draw game. While such second opportunity random-draw games tend to encourage game players to continue to participate in the initial random-draw game, there are drawbacks. The game provider must provide a way for the game player to register the ticket for the second opportunity random-draw game. Recently, this has involved providing an interactive website. The game player accesses the website and then records or registers the game ticket with the game provider. While such interactive websites enable game players to register non-winning tickets and encourage continued participation, a number of game players do not participate.

Accordingly, there is a need in the art to enhance the attractiveness for game players to register non-winning random-draw game tickets with second opportunity random-draw game events. It is to such that the present invention is directed.

BRIEF SUMMARY OF THE INVENTION

The present invention meets the need in the art by providing a network game apparatus associated with a provider of a plurality of random draw games to encourage further play of the random draw games by players holding non-winning game tickets, comprising a plurality of computer devices each for operating by a respective one of a plurality of game players and having a display and a network connection for communicating with a remote server of a provider of a plurality of random draw games, which remote server has a memory device containing a database configured for tracking the plurality of game players, each game player having a unique player identifier and the database having an accumulator associated with the respective game player, which accumulator maintains a determined balance of chips and an experience meter associated with the respective game player. The computer device is configured for display and play of a game that uses selectively one or more of the chips maintained in the accumulator for the game player. The game comprises at least one player play portion that selectively displays on the computer devices the number of chips selected by the game player to play from the available determined balance of the accumulator of the game player, a chip select field for the game player to select the number of chips to be deducted from the accumulator of the game player and placed into play, a control select field containing at least one control feature selectively operative by the game player for play of the game; and a game operator for directing actions of the game during play by the plurality of game players. A game ticket register selectively operated by a respective one of the game players holding a non-winning ticket played in one of the plurality of random draw games of the provider to register the non-winning ticket with the remote server that is configured for providing a plurality of additional chips for the game player upon registration of the non-winning ticket, wherein the accumulator associated with said game player is increased with the additional chips, the amount of additional chips randomly selected from a range of at least a first amount of the additional chips to a second amount of additional chips and providing a value for the experience meter associated with the respective game player based on the number of times the respective game player has played the game, the value of the experience meter applied as a multiplier to the amount of additional chips when increasing the accumulator with the additional chips upon registration of the non-winning game ticket by the respective game player. The computer device configured for execution of game steps directed by the game operator displayed on the display, whereby the game player in a respective first outcome obtains additional chips that increase the amount of chips in the accumulator of the respective game player or in a second outcome the accumulator of the respective game player is unchanged, the game play resulting in the first outcome or the second outcome randomly for each of the plurality of game players playing the game.

In another aspect, the present invention provides a method of playing on a plurality of computer devices by a plurality of game players a networked game provided by a provider of a plurality of random draw games to encourage further play thereof by a game player holding a non-winning ticket played in the random draw games, comprising the steps of:

(a) providing a database on a remote server of a random draw game provider accessible through a network connection of each of a plurality of computer devices, each computer device associated with a respective one of a plurality of game players, the database configured for tracking a plurality of game players, each game player having a unique player identifier and an accumulator associated therewith that maintains a determined balance of chips for use during play of a game on the computer device by the game player, and an experience meter associated therewith;

(b) displaying a game for play on the computer devices of the one or more game players accessing the server selectively for play of the game, comprising:

(i) selecting by at least one devices of the one or more game players accessing the server selectively for play of the game, player a number of chips to play from the available determined balance of the accumulator of the game player;

(ii) deducting from the accumulator of the game player the number of chips selected for play; and (iii) placing the selected number of chips into play during the game;

(c) providing a control select field containing at least one control feature selectively operative by the game player for play of the game;

(d) directing by a game operator actions of the game during play by the plurality of game players (e) selectively registering with a game ticket register of the remote server of the game provider a non-winning ticket of one of the random draw games by a respective one of the game players, wherein the accumulator associated with the game player is increased:

with a plurality of additional chips, the amount of additional chips randomly selected from a range of at least a first amount of additional chips to a second amount of additional chips; and the experience meter having a value based on the number of times the respective game player has played the game, the value of the experience meter applied as a multiplier to the amount of additional chips when increasing the accumulator of the respective game player with additional chips upon registration of the non-winning game ticket by the respective game player and (f) executing game steps displayed on the computer devices, whereby the game player in a respective first outcome obtains additional chips that increase the amount of chips in the accumulator associated with the game player or in a respective second outcome the accumulator associated with the game player is unchanged, the game play resulting in the respective first outcome or the respective second outcome randomly for each of the plurality of game players playing the game.

In another aspect, the present invention provides a method of playing on a plurality of computer devices by a plurality of game players a networked game provided by a provider of a plurality of random draw games to encourage further play thereof by a game player holding a non-winning ticket played in the random draw games, comprising the steps of:

(a) providing a database on a remote server of a random draw game provider accessible through a network connection of each of a plurality of computer devices, each computer device associated with a respective one of a plurality of game players, the database configured for tracking a plurality of game players, each game player having a unique player identifier, an accumulator associated therewith that maintains a determined balance of chips for use during play of a game on the computer device by the game player, and a ladder associated therewith having a plurality of play periods each with a respective amount of award chips;

(b) displaying the game for play on the computer devices of the one or more game players accessing the server selectively for play of the game, comprising:

(i) selecting by at least one game player a number of chips to play from the available determined balance of the accumulator of the game player;

(ii) deducting from the accumulator of the game player the number of chips selected for play; and (iii) placing the selected number of chips into play during the game;

(c) providing a control select field containing at least one control feature selectively operative by the game player for play of the game;

(d) directing by a game operator actions of the game during play by the plurality of game players;

(e) selectively registering with a game ticket register of the remote server of the game provider a non-winning ticket of one of the random draw games by a respective one of the game players, and further increasing the accumulator associated with the game player with a plurality of additional chips upon registering the non-winning ticket, the amount of additional chips randomly selected from a range of at least a first amount of additional chips to a second amount of additional chips, the second amount greater than the first amount, and further increasing the accumulator associated with the game player with the amount of the respective award chips upon registering the non-winning ticket during the respective play period; and resetting the ladder associated with the game player to a beginning play period of the ladder if the game player does not register a non-winning game ticket during one of the play periods;

(f) executing game steps displayed on the computer devices, whereby the game player in a respective first outcome obtains additional chips that increase the amount of chips in the accumulator associated with the game player or in a respective second outcome the accumulator associated with the game player is unchanged, the game play resulting in the respective first outcome or the respective second outcome randomly for each of the plurality of game players playing the game.

In yet another aspect, the present invention provides a networked game apparatus associated with a provider of a plurality of random draw games to encourage further play of the random draw games by players holding non-winning game tickets, comprising a plurality of computer devices each for operating by a respective one of a plurality of game players and having a display and a network connection for communicating with a remote server of a provider of a plurality of random draw games. The remote server having a memory device containing a database configured for tracking the plurality of game players, each game player having a unique player identifier and the database having associated with the respective game player an accumulator that maintains a determined balance of chips of the respective game player and a ladder having a plurality of play periods each with a respective amount of award chips. The computer device configured for display and play of a game that uses selectively one or more of the chips maintained in the accumulator for the game player. The game comprising at least one player play portion that selectively displays on the computer device the number of chips selected by the game player to play from the available determined balance of the accumulator of the game player; a chip select field for the game player to select the number of chips to be deducted from the accumulator of the game player and placed into play; a control select field containing at least one control feature selectively operative by the game player for play of the game; and a game operator for directing actions of the game during play by the plurality of game players. A game ticket register selectively operated by a respective one of the game players holding a non-winning ticket played in one of the plurality of random draw games of the provider to register the non-winning ticket with the remote server that is configured: for providing a plurality of additional chips for the game player upon registration of the non-winning ticket, wherein the accumulator associated with said game player is increased with the additional chips, the amount of the additional chips randomly selected from a range of at least a first amount of additional chips to a second amount of additional chips; and further configured for adding the respective award chips to the accumulator of the game player upon registering the non-winning game ticket during the respective play period, and resetting the ladder to a beginning play period of the ladder of the game player if the game player does not register a non-winning game ticket during a respective one of the ladder play periods. The computer device configured for execution of game steps directed by the game operator displayed on the display, whereby the game player in a respective first outcome of the game obtains additional chips that increase the amount of chips in the accumulator of the respective game player or in a second respective outcome the accumulator of the respective game player is unchanged, the game play resulting in the first outcome or the second outcome randomly for each of the plurality of game players playing the game.

Objects, advantages, and features of the present invention will become readily apparent upon reading the following detailed description in conjunction with the drawings and the appended claims.

DETAILED DESCRIPTION

Figure 1:
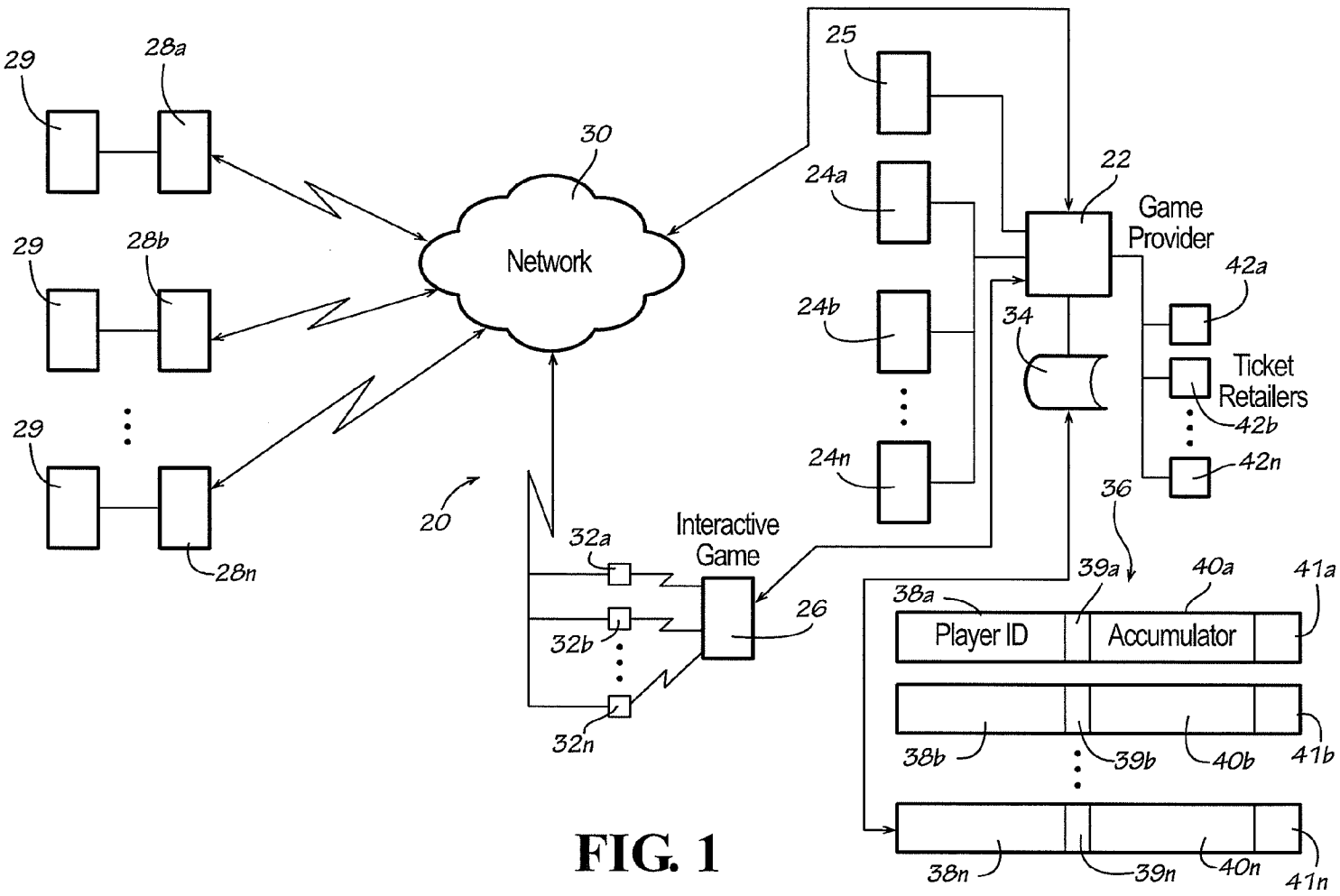
FIG. 1 illustrates a schematic view of a networked game apparatus in accordance with the present invention.

With reference to the drawings in which like parts have like identifiers, FIG. 1 illustrates a schematic view of a networked game apparatus 20 in accordance with the present invention. At least one game provider 22 offers one or more random-draw games 24 and at least one second chance random-draw game 25. The game provider 22 also provides an interactive networked game 26 available for play by one or more game players 28 through a network 30. One or more game players 28 may participate 32 in the game 26.

The interactive game 26 is playable on a computer device 29, for example a mobile computer device such as a portable telephone, personal data assistant, iPad, or the like. The interactive game 26 is configured for play 32 by at least one game player 28, or by a plurality of game players. The game provider 22 offers the interactive game 26 through a remote server accessible through the network 30 to the players 28. The remote server includes a memory device containing a data base 34 configured for tracking game information for the game players 28 participating 32 in the game. The data base 34 includes game player data records 36 having at least a unique identifier 38 associated with each respective particular game player 32, a player password 39, an accumulator 40 for the game player, and a last-played date 41. The accumulator 40 maintains a determined balance of game play chips available to the game player 32 for play of the interactive game 26. In the illustrated embodiment, the chips are characterized as equivalent to dollars. The computer device of the game player 32 is configured for display and play of the game that uses selectively one or more of the chips maintained in the accumulator 40 for the game player.

The game provider 22 offering the random draw games 24 includes a plurality of ticket retailers 42. The ticker retailers 42 communicate conventionally with the game provider 22 for sale, validation and redemption of game tickets for play in the random-draw games 24. At least one of the games comprises the second chance random-draw game 25. Players with non-winning game tickets from one of the play of the games 24 may submit the non-winning game ticket for entry in the second opportunity random draw game 25, as discussed below.

Figure 2:
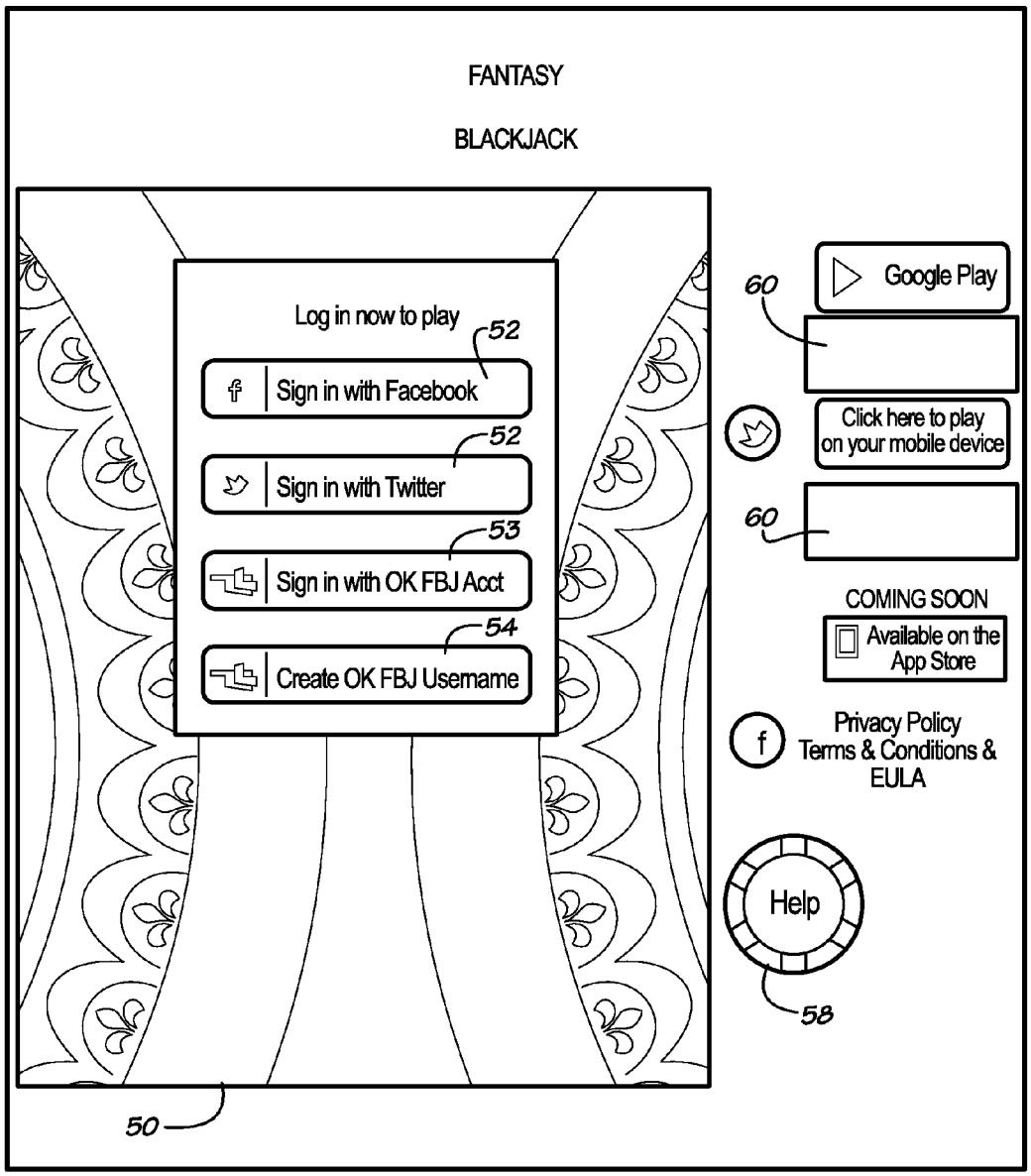
FIG. 2 illustrates a sign-in screen for play of the networked game using a mobile computer device.

FIG. 2 illustrates a sign-in screen 50 for a game player 32 to access the game 26. In one aspect, the illustrated embodiment provides a plurality of log-in options 52 for logging into the game 26 through one or more social media systems such as FACEBOOK, TWITTER, or other social networks affiliated with the game 26. Alternatively, the game player 32 may sign-in with an account 53 set up through the game provider 22. A create user name button 54 opens a window through which the game player 32 may register a user name 38 and password 39 with the game provider 22. In response to creating the account, the game provider 22 updates the database 34 with the player identification 28 or user name 38, creates a password 39 entry associated with the user id, and creates the accumulator 40. A help button 58 provides a link to FAQ's about the game and contact information to get help with play of the game. Social media windows 60 may display text messages from persons active in the particular social media system.

Figure 3:
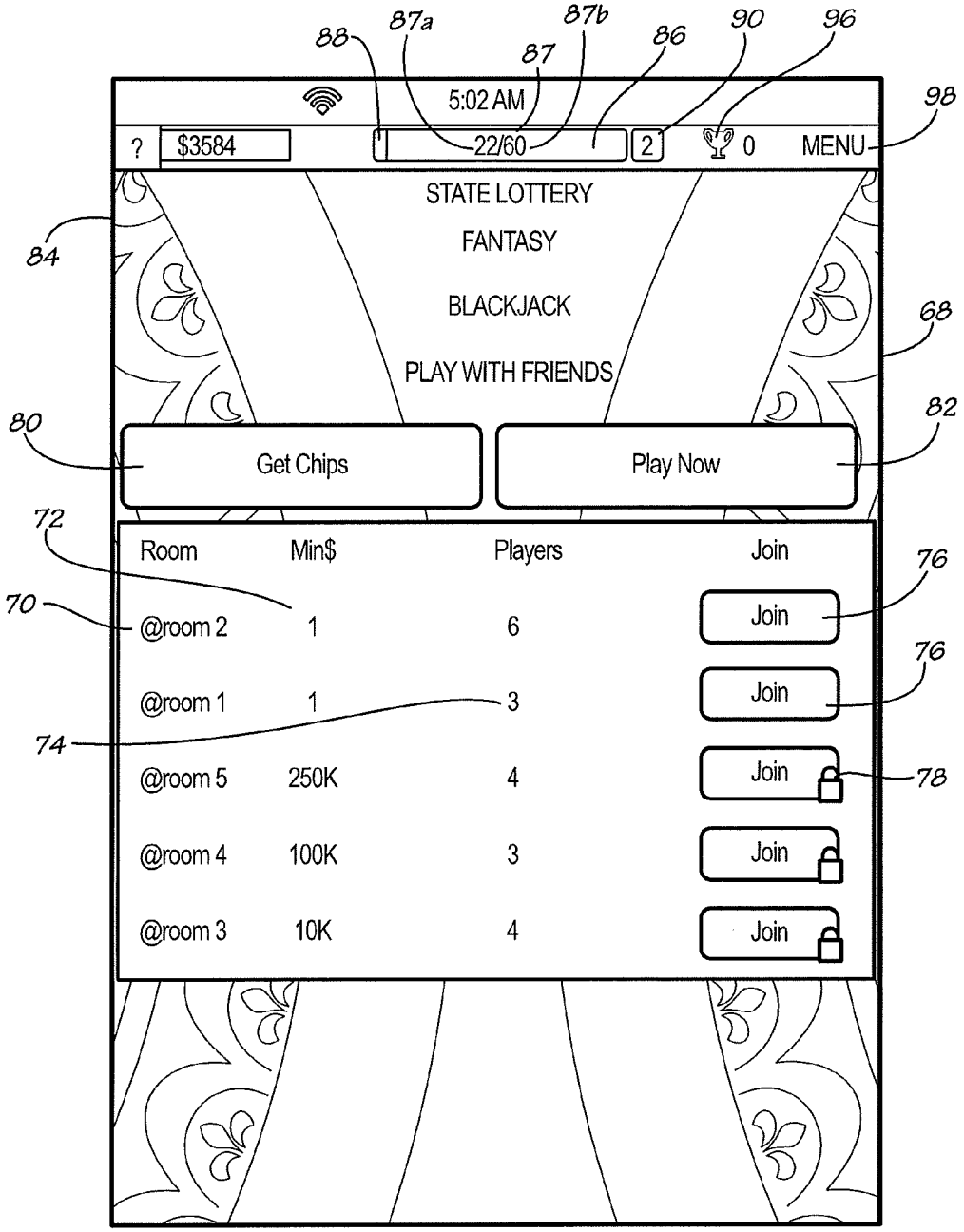
FIG. 3 illustrates a game lobby for play of the networked game.

FIG. 3 illustrates a screen display of a game lobby 68. The game lobby 68 opens after the game player logs-in. The game lobby 68 lists game rooms that the game player may selectively join. The game lobby 68 includes room identification 70, the minimum number 72 of chips for play of the game in the associated room, identification of players 32 already present 74 in the room 70, and a join button 76. A room 70 at capacity is indicated by a padlock symbol 78 on the join button 76. The game lobby 68 includes a get chips button 80 and a play button 82. The get chips button 80 enables a game player 32 to register one or more non-winning game tickets from games 24 of the game provider 22, as discussed below. Upon registration, the player 32 is awarded additional chips as well as entry of the player's game ticket in the second opportunity game 25 of the game provider 22.

The game lobby 68 displays the current chip count 84 for the player. The game 26 provides several ways to increase the chips available to the player for play. These include (a) the get chips button 80 for entering the code associated with a game ticket of a game 24, as discussed below, (b) receiving a periodic bonus for regular play, and (c) winning chips during play of the game. Regular play increases the game experience of a player. The present invention recognizes player game experience. An experience meter 86 tracks game play activity of the player. The meter 86 displays a coded number 87 that reflects the amount of play 87*a* by the game player and a target 87*b* for the player to reach a next experience level. The meter 86 also may have a level indicator 88. Shown as a graphic, the level indicator 88 moves during play progressively from a starting point, to a current level, and ultimately reaches a concluding point for entry to the next experience level. The game lobby 68 indicates the current experience level 90. The experience level 90 is a value in a range of values. The illustrative embodiment indicates the experience level as a numerical value. In one aspect, the experience level is applied as a multiplier when awarding game chips to a player in recognition of periodic play, as discussed below. After a player exceeds the target 87*b*, the experience level 90 increments and the target 87*b* may change to a different number. The play number 87*a* resets to a starting value in the new experience level.

The present invention may also recognize achievements of the player during play of the game. An achievements button 96 causes a pop-up menu to be displayed showing achievements of the player during play of the game. In the illustrative embodiment, the achievements are various Blackjack game events such as drawing three "7's" in a hand, hitting up to five cards in one hand, or getting blackjack or "21" as a value of the dealt cards during play of a hand. Once a game player accomplishes or realizes one of these achievements, the game player receives a trophy icon for the achievements button 96 and an associated bonus amount of chips. The game may be configured so that a player does not benefit from the same achievement twice. The menu button 98 presents a drop-down menu with links to portions for activities of the game including return to the game lobby 68, get additional chips, review achievements, select gifts, and log out.

Figure 4:
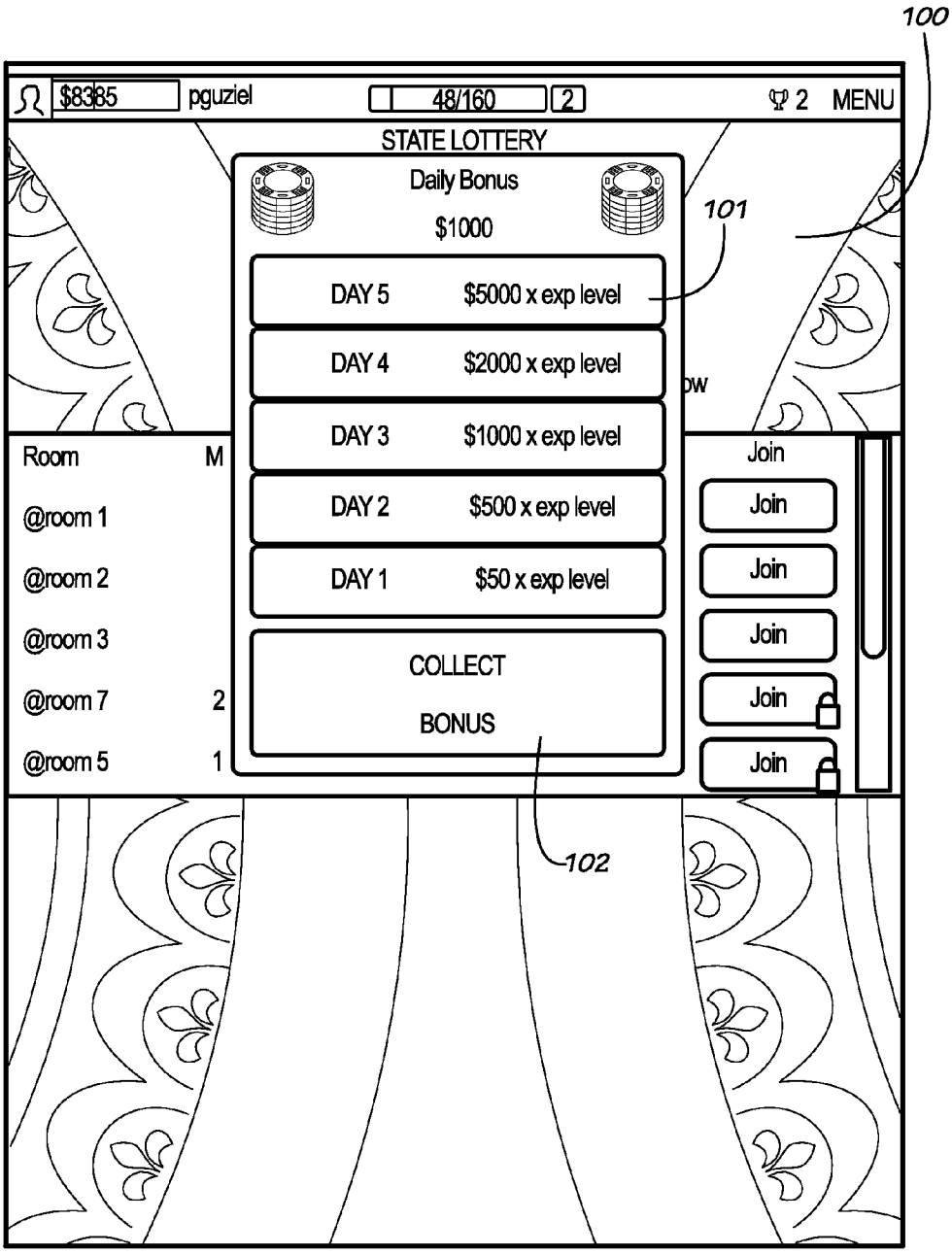
FIG. 4 illustrates a periodic bonus of chips available to the game player for use in the play of the networked game.

FIG. 4 illustrates a periodic bonus screen 100. The purpose of the periodic bonus is to encourage routine and regular play of the game 26 by the game player 32. This is accomplished by awarding game play chips when the player 32 first accesses the game 26 in a particular period, for example, daily. The illustrated embodiment uses a five step ladder generally 101 with incremental based bonus amounts. The database 34 tracks the last play date 41 for the player. The incremental periodic bonus is awarded for a player playing at least once in each of the ladder periods consecutively. If a play period is missed, the periodic bonus starts again at the bottom of the ladder. A collect bonus button 102 activates the daily bonus. In the illustrated embodiment, the amount of the periodic bonus is multiplied by the experience level 90 of the player. The game 26 communicates the value of the bonus chips to the remote server 34 for updating the accumulator 40 for the game player 32. The current chip count 84 is updated. An alternate embodiment presents a rotating wheel that has discreet sections each denominated by a chips value. A pointer designates an award position. The wheel rotates slowly to a stop. When the wheel stops, the pointer points to one section and the chip value for the periodic playing bonus of chips.

Figure 5:
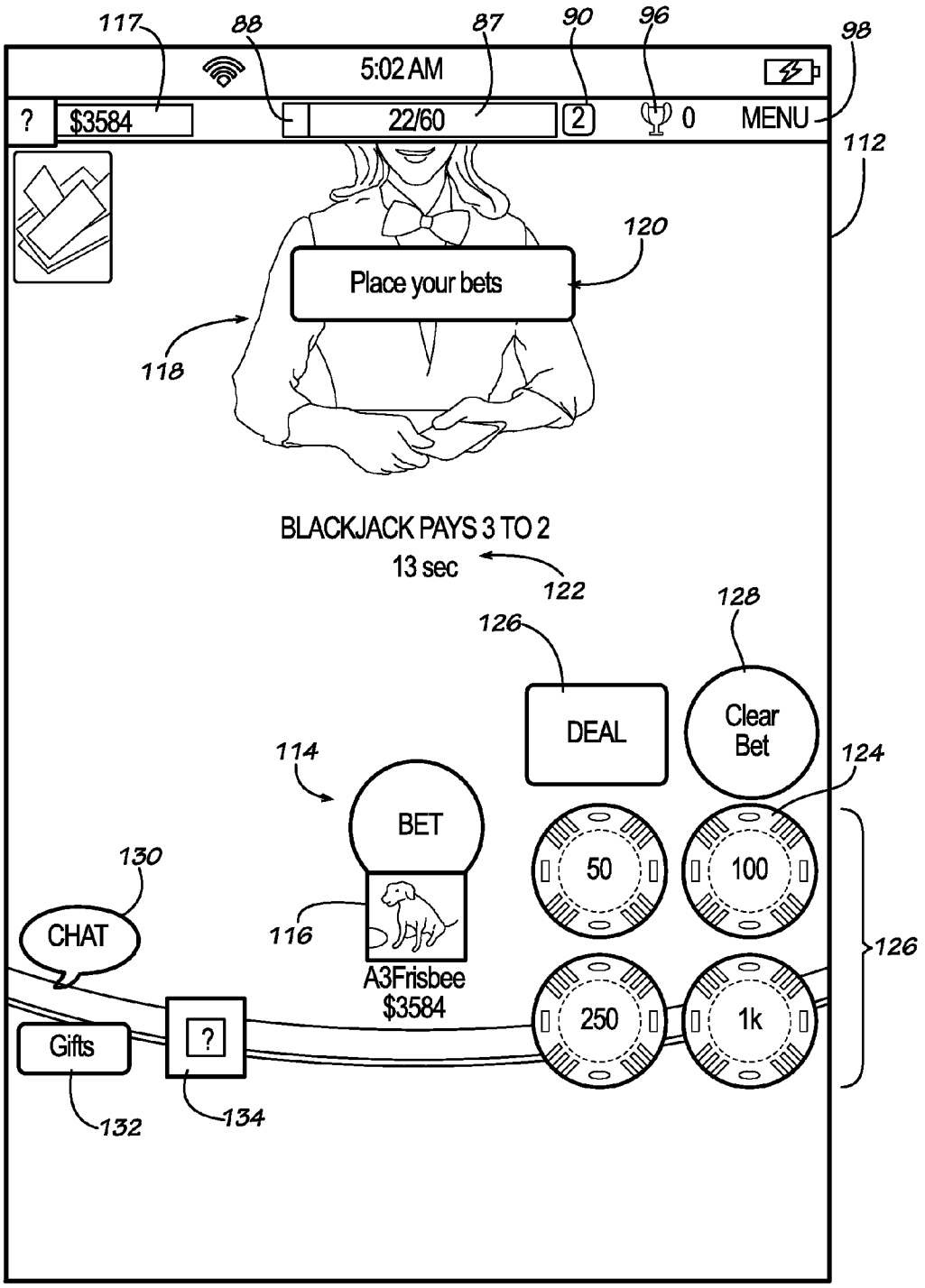
FIG. 5 illustrates the network game during play by a player.

FIG. 5 illustrates play of the game 26 on a game play screen 112. The game play screen 112 includes at least one player play portion 114 that includes an avatar 116 of the game player 32 and may display 117 the value of the player's accumulator 40. In the illustrated embodiment, the player play portion is designated by a circle. The player may select which of the available player positions from which to play. A game operator avatar 118 in the illustrative embodiment simulates a dealer for the blackjack game. A instruction field 120 provides guiding instructions during play of the game. A countdown timer 122 provides a countdown clock for the player to take action in accordance with the instructions in the instruction window 120. A plurality of chip selection buttons 124 in a select field generally 126 allows the player to select the number of chips to be deducted from the accumulator 40 and placed into play for a particular deal or round of the game. In the illustrative embodiment, four different chip selection buttons 124 are provided. In an alternate embodiment, the game may provide for the game player 32 to designate one or more of the buttons 124 with a player-specified number of chips.

In addition, the game play screen 112 includes at least one control feature button for selective operation by the game player for play of the game. The illustrative embodiment includes a deal button 126 and a clear button 128. The deal button 126 directs the game 26 to commence or to continue play of a particular hand of the game. In this way, the game player does not have to wait for the countdown timer 122 to expire. The clear button 128 removes the selected number of chips to be played in a hand and returns the chips to the accumulator 40 for the player. A chat button 130 opens a text box and keyboard. The game player may key-in a message to be communicated to other players shown on the game play screen 112. A gifts button 132 transfers the display to a gifts selection window, as discussed below. A help button 134 presents FAQ's or a selectively accessed user manual for assistance.

Figure 6:
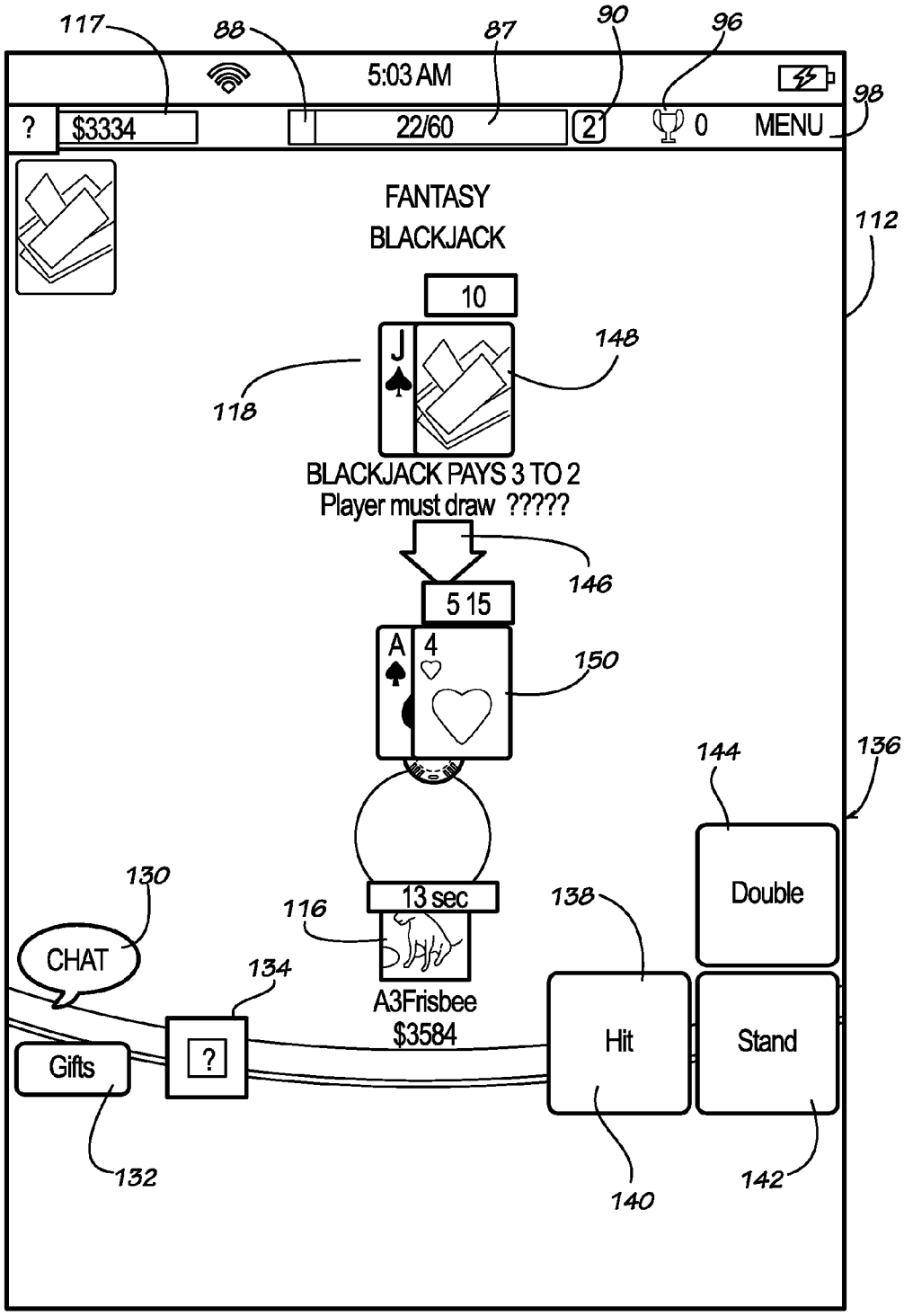
FIG. 6 illustrates features of the play of the networked game.

FIG. 6 illustrates further play of the hand on the game play screen 112. As noted above, play of the hand is commenced after the player 32 has selected the number of chips to be played in the hand. The game play screen 112 next displays a control select field 136. The control select field 136 includes at least one control feature 138 selectively operative by the game player 32 for play of the hand. In the illustrative embodiment of a blackjack game, the control feature buttons are hit 140, which directs the game operator 118 to deal an additional card; stand 142, which directs the game operator 118 to not deal additional cards to the player; and double 144 which doubles the game chips in play by the player 132. A play next arrow 146 points to the player or game operator to specify the next game action. The game play screen 112 includes a game operator play area 148 and a player play area 150 for each of the players in the game room. Each of the respective play areas 148, 150 displays cards 152 (for the illustrative embodiment of a blackjack game). The player play area 150 includes the player avatar and the number of chips accumulated by the player.

Figure 7A:
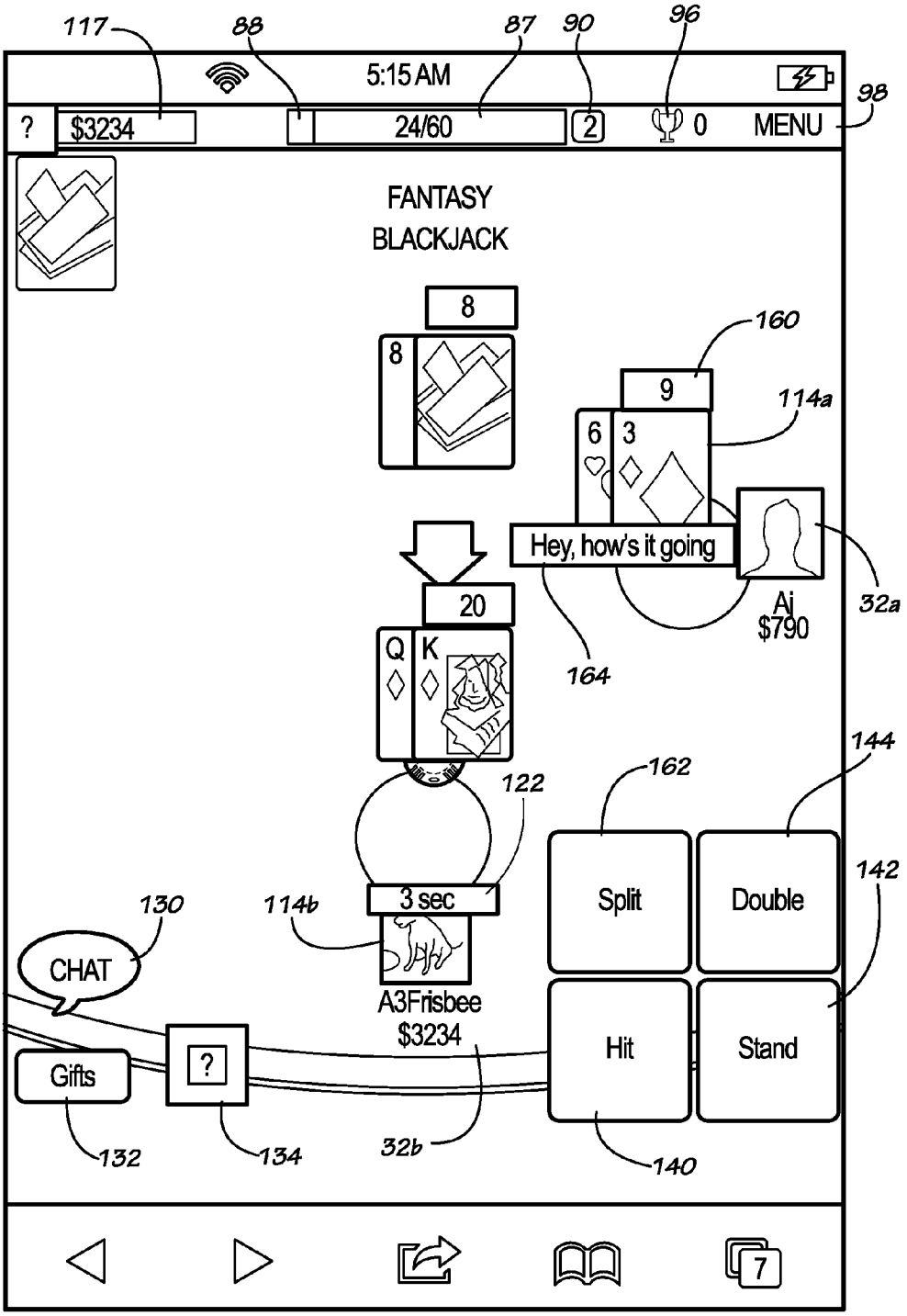
FIGS. 7A and 7B illustrate intraplayer communication during play of the network game.

FIG. 7A illustrates further play of the hand. Two players 32*a* and 32*b* each have a respective play portion 114. The control select field 136 includes an additional control feature for a split button 162. The split button 162 becomes active when a player has two cards of the same value. FIG. 7*a* illustrates the player play portion 114*a* with two face cards. Under the rules of Blackjack, the player 32*a* is permitted to split the cards and play two hands.

The chat button 130 is selectively activated by the player for social interaction with other players. This brings up a keyboard (not illustrated). The game player (32*b*) for example may type in a message which is displayed to the other players in the game. The message is displayed in a message window 164 near the player 32*b*, as if the player were speaking.

Figure 7B:
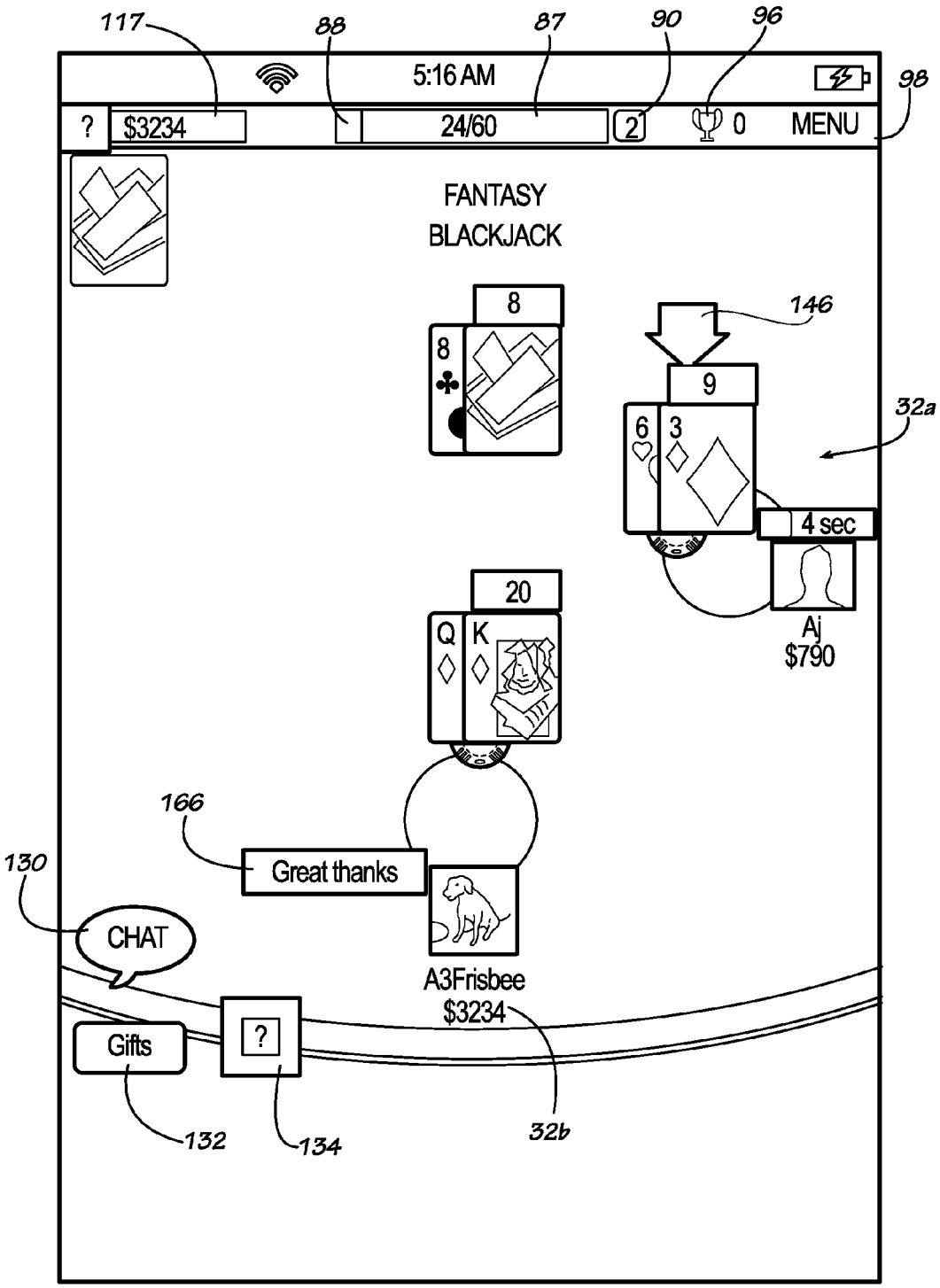

With reference to FIG. 7B, another game player 32 may respond by activating the chat button 130 on the player's computer device. The keyboard (not illustrated) is displayed for the other player (32*a*) to type a message which communicates to the other players in the game. The response message is displayed in a text window 166 near the player 32*a* as if he were speaking. The players 32*a*, 32*b* may thereby interact within the play of the game. In a single player game, the operator avatar 118 may respond or post comments to the player.

Figure 8:
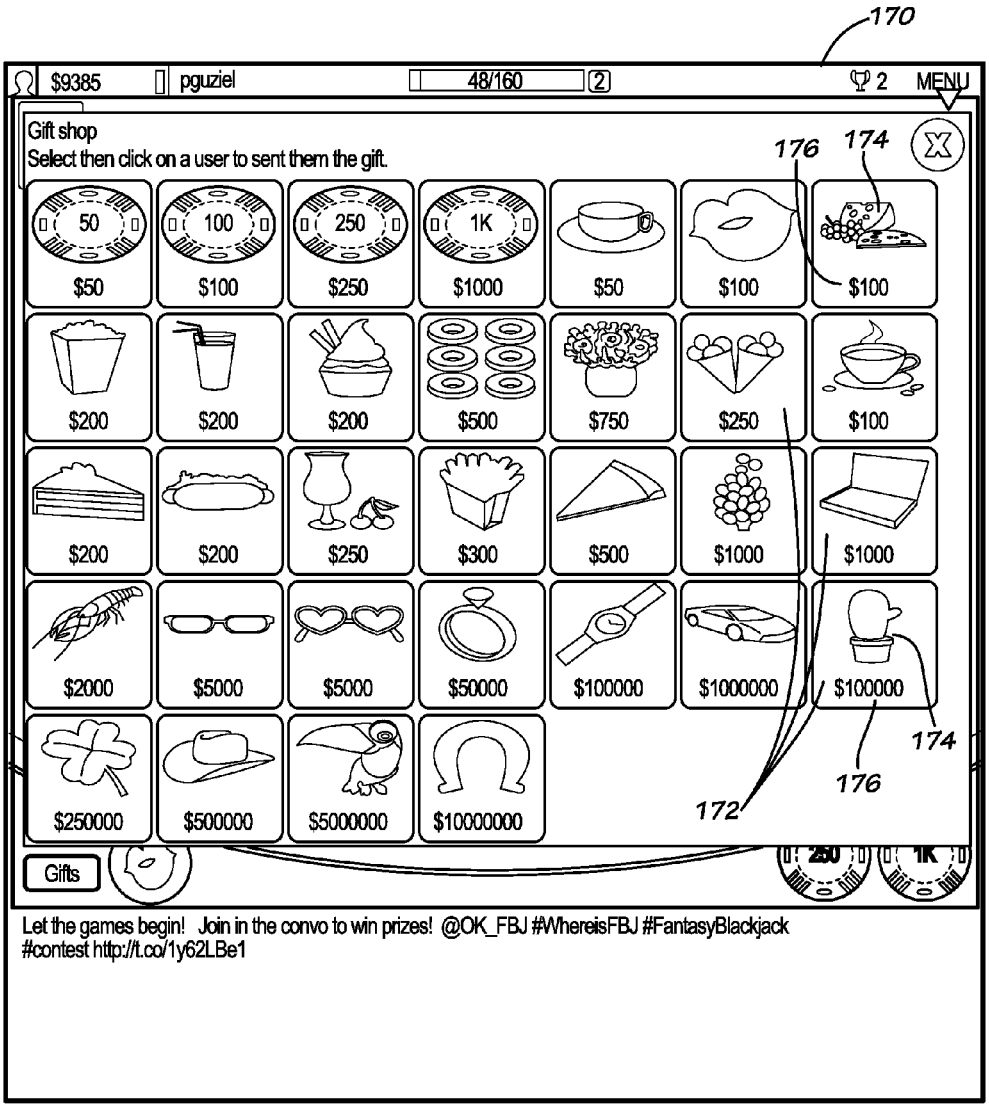
FIG. 8 illustrates a gift-selection screen whereby the game player may use chips to receive selected gifts or to send a gift to another player during play of the networked game.

FIG. 8 illustrates a catalog or gift selection window 170 accessed by the menu 98 or by the gifts button 132. The window 170 displays a plurality of gift icons 172. The player may select a gift for directing the gift to himself or to one of the other game players. Each gift icon 172 includes a graphic representative of the particular gift and associated cost 176. The cost 176 is deducted from the accumulator 40 of the game player 32. Upon selecting one of the gift icons 172, a popup window appears. The popup window lists the players 32 active in the game. The game player 32 selects one of the players to receive the gift. The gift communicates to the selected player with an announcement. The announcement may be selectively typed by the game player or may be selected from a plurality of pre-entered messages (not illustrated). In the illustrated embodiment, the gifts 172 are virtual. Gifts include symbolic messages and articles as well as chips. In an alternate jurisdiction, the gifts 170 may be actual.

Figure 9:
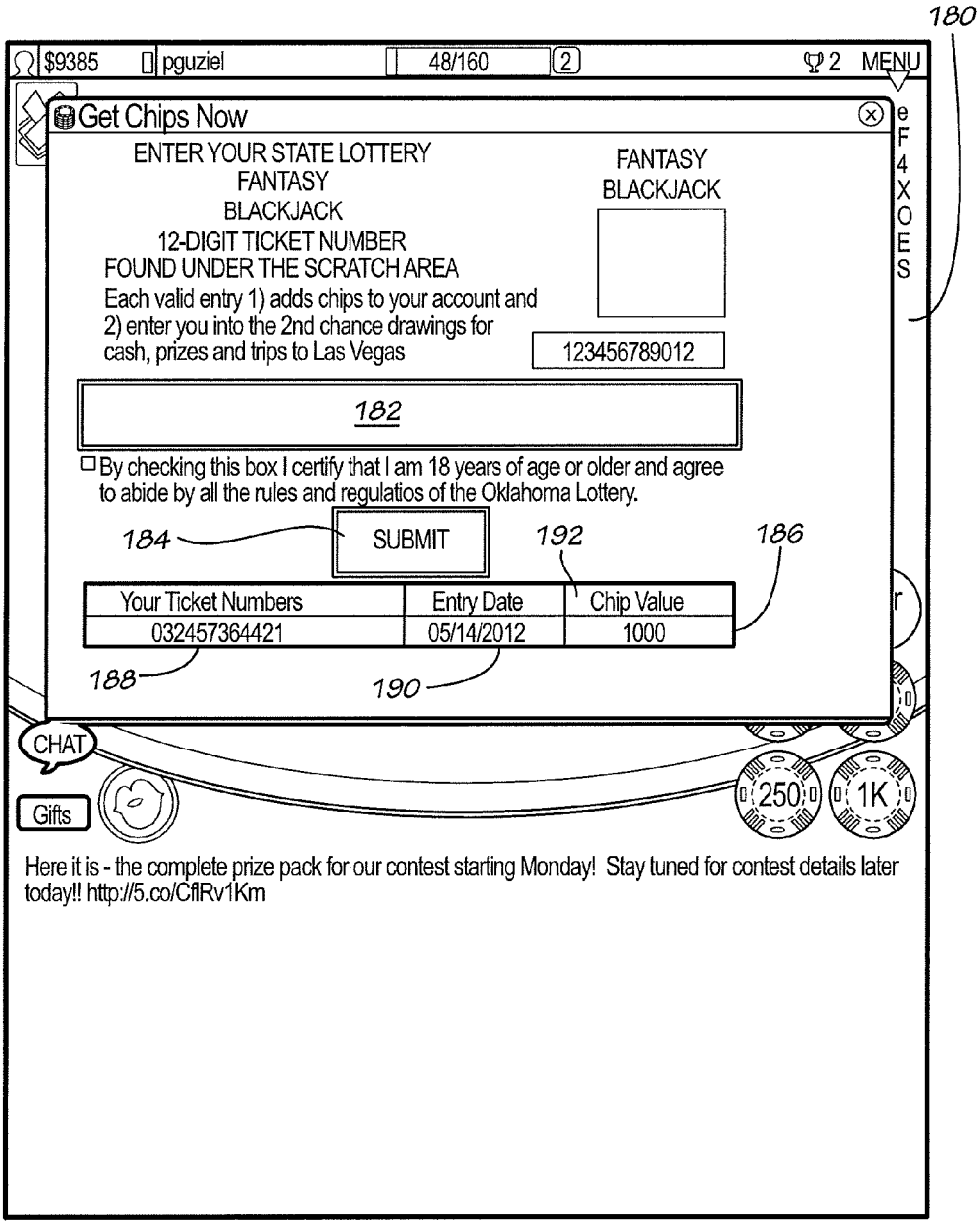
FIG. 9 illustrates registration of a non-winning game ticket by the player for entry in a second opportunity random-draw game.

FIG. 9 illustrates a screen 180 for entry of a non-winning game ticket in a second opportunity random-draw game 25 offered by the game provider 22. The screen 180 is accessed through the get chips button 80. In response to the player 32 entering a non-winning game ticket, the game player may be awarded additional chips for play of the game 26. The screen 180 presents a text entry box 182. A keyboard (not illustrated) is presented by which the game player may enter the ticket number into the text field 182. A submit button 184 submits the entered number to the remote server of the game provider 22. The ticket number is validated, and if valid, the player is awarded additional chips for play of the game 26. The player is also entered with that game ticket in the second opportunity random-draw game 25. A verification window 186 displays the ticket numbers entered 188 by the game player, the entry date 190 for the second opportunity random-draw game, and the awarded value of chips 192. The awarded value 192 increases the number of chips available in the accumulator 40 for the player. The display 84 is updated.

With reference to FIGS. 1 and 2, the networked game 26 is operated by a game player 32 to enjoy a participation game while selectively engaging in the second opportunity random-draw game 25 offered by the game provider 22. The game player 32 initially logs-in using the computer device 29 connected to the network 30. The networked game 26 according to the present invention keeps track of the number of game chips available to a player as well as keeping track of "experience levels" and "achievement levels."

With reference to FIG. 2, the game player 32 accesses the game 26 using the log-in screen 50. The game player 32 selects one of the log-in options 52 providing access to a social media network affiliated with the game 26 or alternatively uses the account 53 set up with the game provider 22. The social media windows 60 displays text messages from persons active in the particular social media system, which text messages may reference the game 26 and the players 32 playing the game.

The computer device 29 displays the game lobby 68. However, if the particular instance of play is the first within a predetermined period, the game 26 in the illustrated embodiment first provides the periodic bonus screen 100 shown in FIG. 4. The player selects the collect bonus button 102. The game 26 then determines which step of the ladder 101 is appropriate for awarding the bonus number of chips. The bonus may be multiplied by the experience level 90 of the player. A bonus display window 103 shows the amount of the awarded periodic bonus. This amount is added to the accumulator 40 for the player and the total 84 is updated on the game lobby 68. An alternate embodiment uses a multiple section wheel that slowly rotates to a stop. The value of the bonus chips is displayed on the section of the wheel indicated by pointers.

Upon display of the game lobby 68, the game player 32 selects one of the rooms 70 in which to play. This is accomplished by pressing the join button 76 for the room having space for an additional player. The player may select the room based on the minimum chips 72 for play of the game in the room with or the player may join a room other players of whom he is familiar.

The player 32 may obtain additional chips by activating the get chips button 80. The get chips button 80 presents the screen for the player 32 to enter the ticket code associated with a non-winning game ticket of a game 24 of the game provider 22. Upon activation of the get chips button 80, the display presents the text field 182 and a keyboard (not illustrated) for entering the unique identifier of the non-winning game ticket. Upon entry of the identifier of the non-winning game ticket, the game 26 communicates the identifier to the remote server for validation. Upon validation, the remote server awards additional chips to the player. In one embodiment, the game selects randomly from a range of numbers of additional chips to be awarded to the player 32. That determined award is returned to the computer device of the player 32. The accumulator 40 is increased by the additional number of chips. The current chip count 84 is updated to reflect the total in the accumulator 40. The summary window 184 displays the ticket code 188, the date 190 of the second opportunity random-draw game 25, and the number of bonus chips awarded for use in the game 26.

The play button 82 commences the play of the game 26. With reference to FIG. 5, the game play screen 112 displays the player's avatar 116 with the operator avatar 118. In the illustrated embodiment, the operator avatar 118 simulates a dealer for a blackjack game. The instruction field 120 provides guided instructions during play of the game. Initially, the player 32 is requested to select the number of chips to play for the particular deal or round of the game. The player selects one of the chip selection buttons 124. In the embodiment providing for the game player to enter a selected number of chips, the game displays a numerical keypad for entry of the number of chips to be played. Upon submission of the number of chips for play in the particular deal, the game operator 118 moves to the next player in sequence. The play next arrow 146 indicates which player 32 or operator 118 is to make the next action. Once the cards have been dealt, the player 32 may select the play button. Otherwise play commences when the countdown timer 122 reaches zero. If the particular player has not made an action (i.e., entered the number of chips to play or press the deal button), the player is skipped and is not participating in the particular deal.

During play of the game, the game player 32 may selectively participate in features of the game. With reference to FIG. 6, for example, control feature buttons 140 direct the game operator to deal an additional card to the player. The stand button 142 directs the game operator to not deal an additional card to the player. The double button 144 doubles the game chips in play. In addition, as illustrated in FIG. 7, the split field 162 allows the player to split when receiving cards of equal value.

The computer device 29 is configured for execution of game steps as directed by the game operator displayed on the display or by the game player, until an outcome of the game is reached, whereby the game player in a first outcome obtains additional chips that increase the number of chips in the accumulator or in a second outcome the accumulator is unchanged, with the game play resulting in the first outcome or the second outcome randomly.

Further, with reference to FIGS. 7A and 7B the chat button 130 selectively activated by the player enables the player 32 to send a message to other players in the game. The message is displayed in a message window 164. Additional players 32 may respond by activating the chat button 130 for response messages displayed in text windows 166. The players 32*a*, 32*b* thereby interact within the play of the game.

It is to be appreciated that the present invention incorporates social media features to make for a more rewarding play. The game player 32 may invite friends to play the networked game 20 using conventional social media networks such as TWITTER, FACEBOOK, or other such social media systems. The system is configured to recognize each log-in as a different account and thus will keep separate accumulated totals, experience, and achievement levels, for the player based on the access button used for entry to the game 26. Players may readily install the game application on the computer device 29 by downloading from a conventional on-line application provider.

The login using a social media identifier will require authorization for use of minimum personal information (first name, last name, user name, login password, and associated email address). In this way, the game provider 22 may contact the game player 32 in the event one of the game tickets registered by the game player with the system is selected as a winner in the second chance random draw game. In an alternative embodiment, the networked game apparatus 20 further requests access to social media networks in order to instantly share achievements of the game player 32 via the particular social network account.

While the illustrated embodiment depicts a Blackjack card game for the game 26, other card games, board games, player participation games, including either conventional or coined for play, may readily be applied to embodiments of the present invention, for play by a player to facilitate participation in random-draw games 24 of the game provider 22 and providing the second opportunity game 25. The games provide at least one player play portion that selectively displays selected by the player to play from the available determined balance of the chip accumulator of the game player. The game includes the chip select field for the player to select the number of chips to be deducted from the accumulator of the player and placed into play. A control select field containing at least one control feature selectively operative by the game player for play of the game.

Although a particular embodiment of the invention has been illustrated and described, various changes may be made in the structure, construction, and arrangement of the parts herein without sacrificing any of its advantages. Therefore, it is to be understood that all matter herein is to be interpreted as illustrative and not in any limiting sense, and it is intended to cover in the appended claims such modifications as come within the spirit and scope of the invention.

What is claimed is:

1. A networked game apparatus associated with a provider of a plurality of random draw games to encourage further play of the random draw games by players holding non-winning game tickets, comprising:

a plurality of computer devices each for operating by a respective one of a plurality of game players and having a display and a network connection for communicating with a remote server of a provider of a plurality of random draw games;

the remote server having a memory device containing a database configured for tracking the plurality of game players, each game player having a unique player identifier and the database having an accumulator associated with the respective game player, which accumulator maintains a determined balance of chips of the respective game player and an experience meter associated with the respective game player;

the computer device configured for display and play of a game that uses selectively one or more of the chips maintained in the accumulator for the game player;

the game comprising:

at least one player play portion that selectively displays on the computer device the number of chips selected by the game player to play from the available determined balance of the accumulator of the game player;

a chip select field for the game player to select the number of chips to be deducted from the accumulator of the game player and placed into play;

a control select field containing at least one control feature selectively operative by the game player for play of the game; and a game operator for directing actions of the game during play by the plurality of game players;

a game ticket register selectively operated by a respective one of the game players holding a non-winning ticket played in one of the plurality of random draw games of the provider to register the non-winning ticket with the remote server that is configured for providing a plurality of additional chips for the game player upon registration of the non-winning ticket, wherein the accumulator associated with said game player is increased with the additional chips, the amount of the additional chips randomly selected from a range of at least a first amount of additional chips to a second amount of additional chips; and providing a value for the experience meter associated with the respective game player based on the number of times the respective game player has played the game, the value of the experience meter applied as a multiplier to the amount of additional chips when increasing the accumulator with the additional chips upon registration of the non-winning game ticket by the respective game player, and the computer device configured for execution of game steps directed by the game operator displayed on the display, whereby the game player in a respective first outcome of the game obtains additional chips that increase the amount of chips in the accumulator of the respective game player or in a second respective outcome the accumulator of the respective game player is unchanged, the game play resulting in the first outcome or the second outcome randomly for each of the plurality of game players playing the game.

2. The networked game apparatus as recited in claim 1, further comprising a local communication feature that upon selective activation by the game player interactively displays text of the game player to other of the plurality of game players playing the game displayed on the respective computer device.

3. The networked game apparatus as recited in claim 1, further comprising a gifts feature, whereby a plurality of gift items are selectively directed by a respective one of the game players to said game player or to one of the other of the plurality of game players, each gift item having an associated cost that is deducted from the accumulator of said game player.

4. The networked game apparatus as recited in claim 1, further comprising a last-played field associated with the game player, whereby the game player playing the game during a predetermined period is awarded additional chips when playing the game in a respective predetermined period, which additional chips increase the number of chips maintained by the accumulator of the game player.

5. The networked game apparatus as recited in claim 1, wherein the registration of the non-winning game ticket comprises the game player entering through the computer device as text a unique game ticket identifier printed on the non-winning game ticket, the remote server configured for validating the unique game ticket identifier.

6. The networked game apparatus as recited in claim 5, whereupon validation of the non-winning game ticket, the remote server increases the accumulator of the game player by the amount of chips selected randomly.

7. The networked game apparatus as recited in claim 1, further comprising a imaging device operative on the computer device, the game further configured with instructions for imaging a code printed on the non-winning game ticket which code encapsulates a unique game ticket identifier of the game ticket and for communicating the unique game ticket identifier to the remote server.

8. The networked game apparatus as recited in claim 1, further comprising the game configured to recognize achievement of a game event by the game player during play of the game by awarding an amount of bonus chips added to the accumulator of the game player.

9. The networked game apparatus as recited in claim 1, wherein the database further comprising a ladder associated with a respective game player, said ladder having a plurality of play periods each with a respective amount of award chips, the respective award chips added to the accumulator of the game player upon registering the non-winning game ticket during the respective play period.

10. The networked game apparatus as recited in claim 9, wherein the database configured to reset the ladder to a beginning play period of the ladder if the game player does not register a non-winning game ticket during one of the ladder play periods.

11. The networked game apparatus as recited in claim 1, further comprising a second opportunity game register that registers the game player for play of a second opportunity random draw game offered by the provider upon the game player registering a non-winning game ticket.

12. A method of playing on a plurality of computer devices by a plurality of game players a networked game provided by a provider of a plurality of random draw games to encourage further play thereof by a game player holding a non-winning ticket played in the random draw games, comprising the steps of:

(a) providing a database on a remote server of a random draw game provider accessible through a network connection of each of a plurality of computer devices, each computer device associated with a respective one of a plurality of game players, the database configured for tracking a plurality of game players, each game player having a unique player identifier, an accumulator associated therewith that maintains a determined balance of chips for use during play of a game on the computer device by the game player, and an experience meter associated therewith;

(b) displaying a game for play on the computer devices of the one or more game players accessing the server selectively for play of the game, comprising:

(i) selecting by at least one game player a number of chips to play from the available determined balance of the accumulator of the game player;

(ii) deducting from the accumulator of the game player the number of chips selected for play; and (iii) placing the selected number of chips into play during the game;

(c) providing a control select field containing at least one control feature selectively operative by the game player for play of the game;

(d) directing by a game operator actions of the game during play by the plurality of game players;

(e) selectively registering with a game ticket register of the remote server of the game provider a non-winning ticket of one of the random draw games by a respective one of the game players, wherein the accumulator associated with the game player is increased:

with a plurality of additional chips, the amount of additional chips randomly selected from a range of at least a first amount of additional chips to a second amount of additional chips, the second amount greater than the first amount, and the experience meter having a value based on the number of times the respective game player has played the game, the value of the experience meter applied as a multiplier to the amount of additional chips when increasing the accumulator of the respective game player with additional chips upon registration of the non-winning game ticket by the respective game player; and (f) executing game steps displayed on the computer devices, whereby the game player in a respective first outcome obtains additional chips that increase the amount of chips in the accumulator associated with the game player or in a respective second outcome the accumulator associated with the game player is unchanged, the game play resulting in the respective first outcome or the respective second outcome randomly for each of the plurality of game players playing the game.

13. The method as recited in claim 12, further comprising the step of interactively displaying text of a message from a respective one of the game players to other of the game players playing the game, the text selectively entered into the game using a communication feature of the computer device activated by said game player.

14. The method as recited in claim 12, further comprising the step of a respective one of the game players providing a gift icon to said game player or to one of the other of the game players by said game player, the gift icon selected from a plurality of gift icons and each gift icon having an associated cost that is deducted from the accumulator of said game player.

15. The method as recited in claim 12, further comprising the step of tracking the last-played date of the game player and awarding the game player additional chips during a respective predetermined period, whereby the additional chips awarded for play in said predetermined period increases the amount of chips maintained by the accumulator of the game player.

16. The method as recited in claim 12, wherein the step of selectively registering further comprises the game player entering through the computer device as text a unique game ticket identifier printed on the non-winning game ticket and the computer device communicating the non-winning game ticket identifier to the remote server.

17. The method as recited in claim 16, further comprising the step of validating by the provider the unique game ticket identifier, whereupon validation of the game ticket, the accumulator of the game player increases by the amount of additional chips selected randomly.

18. The method as recited in claim 12, wherein the step of selectively registering comprises the game player imaging with the computer device a code printed on the non-winning game ticket which code encapsulates a unique game ticket identifier of the non-winning game ticket and communicating the unique game ticket identifier to the remote server.

19. The method as recited in claim 18, further comprising the step of validating the unique identifier, whereupon validation of the game ticket, the accumulator of the game player increases by the amount of additional chips selected randomly.

20. The method as recited in claim 12, further comprising the step of configuring the game to recognize achievement of a game event by the game player during play of the game by awarding an amount of bonus chips added to the accumulator of the game player.

21. The networked game apparatus as recited in claim 12, further comprising the step of providing a ladder associated with the respective game player and having a plurality of play periods each with a respective amount of award chips, the respective award chips added to the accumulator of the game player upon registering the non-winning game ticket during the respective play period.

22. The networked game apparatus as recited in claim 21, further comprising resetting the ladder to a beginning play period of the ladder if the game player does not register a non-winning game ticket during one of the ladder play periods.

23. The networked game apparatus as recited in claim 12, further comprising the step of providing a second opportunity game register that registers the game player for play of a second opportunity random draw game offered by the provider upon the game player registering a non-winning game ticket.

24. A method of playing on a plurality of computer devices by a plurality of game players a networked game provided by a provider of a plurality of random draw games to encourage further play thereof by a game player holding a non-winning ticket played in the random draw games, comprising the steps of:

(a) providing a database on a remote server of a random draw game provider accessible through a network connection of each of a plurality of computer devices, each computer device associated with a respective one of a plurality of game players, the database configured for tracking a plurality of game players, each game player having a unique player identifier, an accumulator associated therewith that maintains a determined balance of chips for use during play of a game on the computer device by the game player, and a ladder associated therewith having a plurality of play periods each with a respective amount of award chips;

(b) displaying the game for play on the computer devices of the one or more game players accessing the server selectively for play of the game, comprising:

(i) selecting by at least one game player a number of chips to play from the available determined balance of the accumulator of the game player;

(ii) deducting from the accumulator of the game player the number of chips selected for play; and (iii) placing the selected number of chips into play during the game;

(c) providing a control select field containing at least one control feature selectively operative by the game player for play of the game;

(d) directing by a game operator actions of the game during play by the plurality of game players;

(e) selectively registering with a game ticket register of the remote server of the game provider a non-winning ticket of one of the random draw games by a respective one of the game players, and further increasing the accumulator associated with the game player with a plurality of additional chips upon registering the non-winning ticket, the amount of additional chips randomly selected from a range of at least a first amount of additional chips to a second amount of additional chips, the second amount greater than the first amount, and further increasing the accumulator associated with the game player with the amount of the respective award chips upon registering the non-winning ticket during the respective play period; and resetting the ladder associated with the game player to a beginning play period of the ladder if the game player does not register a non-winning game ticket during one of the play periods;

(f) executing game steps displayed on the computer devices, whereby the game player in a respective first outcome obtains additional chips that increase the amount of chips in the accumulator associated with the game player or in a respective second outcome the accumulator associated with the game player is unchanged, the game play resulting in the respective first outcome or the respective second outcome randomly for each of the plurality of game players playing the game.

25. A networked game apparatus associated with a provider of a plurality of random draw games to encourage further play of the random draw games by players holding non-winning game tickets, comprising:

a plurality of computer devices each for operating by a respective one of a plurality of game players and having a display and a network connection for communicating with a remote server of a provider of a plurality of random draw games;

the remote server having a memory device containing a database configured for tracking the plurality of game players, each game player having a unique player identifier and the database having associated with the respective game player an accumulator that maintains a determined balance of chips of the respective game player and a ladder having a plurality of play periods each with a respective amount of award chips;

the computer device configured for display and play of a game that uses selectively one or more of the chips maintained in the accumulator for the game player;

the game comprising:

at least one player play portion that selectively displays on the computer device the number of chips selected by the game player to play from the available determined balance of the accumulator of the game player;

a chip select field for the game player to select the number of chips to be deducted from the accumulator of the game player and placed into play;

a control select field containing at least one control feature selectively operative by the game player for play of the game; and a game operator for directing actions of the game during play by the plurality of game players;

a game ticket register selectively operated by a respective one of the game players holding a non-winning ticket played in one of the plurality of random draw games of the provider to register the non-winning ticket with the remote server that is configured for providing a plurality of additional chips for the game player upon registration of the non-winning ticket, wherein the accumulator associated with said game player is increased with the additional chips, the amount of the additional chips randomly selected from a range of at least a first amount of additional chips to a second amount of additional chips; and further configured for adding the respective award chips to the accumulator of the game player upon registering the non-winning game ticket during the respective play period, and resetting the ladder to a beginning play period of the ladder of the game player if the game player does not register a non-winning game ticket during a respective one of the ladder play periods; and the computer device configured for execution of game steps directed by the game operator displayed on the display, whereby the game player in a respective first outcome of the game obtains additional chips that increase the amount of chips in the accumulator of the respective game player or in a second respective outcome the accumulator of the respective game player is unchanged, the game play resulting in the first outcome or the second outcome randomly for each of the plurality of game players playing the game.

* * * * *